United States Patent [19]

Geng et al.

[11] Patent Number: 4,927,035

[45] Date of Patent: May 22, 1990

[54] AUTOMATIC COUPLING FOR RAIL BORNE VEHICLES

[75] Inventors: Markus Geng, Stühlingen, Fed. Rep. of Germany; Dominique Loutan, Geneva, Switzerland

[73] Assignee: Georg Fischer AG

[21] Appl. No.: 353,347

[22] Filed: May 17, 1989

[30] Foreign Application Priority Data

May 17, 1988 [CH] Switzerland ..... 01879/88

[51] Int. Cl.[5] ..... B61G 3/00

[52] U.S. Cl. ..... 213/77; 213/177

[58] Field of Search ..... 213/75 R, 42, 201, 20, 213/1.3, 77, 101, 176, 177, 185, 186, 91, 92, 80, 81, 88, 89, 90

[56] References Cited

U.S. PATENT DOCUMENTS 506,598 10/1893 Koch ..... 213/177

4,703,862 11/1987 Werner ..... 213/77 X

*Primary Examiner*—Andres Kashnikow

*Assistant Examiner*—Virna L. Mojica

*Attorney, Agent, or Firm*—Toren, McGeady & Associates

[57] ABSTRACT

Each coupling head of a vehicle coupling comprises a spring accumulator 50 consisting of compression springs 27, 30 which are energized by a pressure bar 20 when a tension bolt 3 of the head is moved inward. The coupling of the tension bolt 3 in a tension bolt receptacle 4 occurs by engagement levers 12, which are locked by a displaceable frame 16 in the coupled state. The unlocking is remotely operable by actuation of a solenoid 45 which actuates a latch 32 through an unlocking bar 41. Because of this unlocking, the frame 16 is displaced by the force of the spring accumulator, so that the locking of the engagement levers 12 is released and the coupling can be decoupled.

16 Claims, 3 Drawing Sheets

AUTOMATIC COUPLING FOR RAIL BORNE VEHICLES

The invention is directed to an automatic coupling for rail borne vehicles.

BACKGROUND OF THE INVENTION

Such automatic couplings are known, wherein considerable force is required for their release, which partially depends also upon the momentary tractive force acting between the coupling parts during the decoupling process.

Remote control of the decoupling process from the operator's cab is required for automatic operation, and the decoupling process must be assured even when greater traction forces are involved.

In the future, one anticipates an increasing quantity of so-called "all electric" rail borne vehicles, especially trolleys and subways, so that remote control of the decoupling apparatus without compressed air assistance is required.

SUMMARY OF THE INVENTION

An object of the present invention is the creation of an automatic coupling of the above-mentioned type, in which decoupling is possible with low energy consumption, also when a large tractive force is acting on the coupling. As a result, relatively inexpensive electrical actuation devices can be used, especially applicable in a remotely controlled decoupling process.

In accordance with one aspect of the invention, a coupling head of the automatic coupling is provided with energy storing means operable to store energy during the coupling process. This stored energy is released during the decoupling process and assists in the decoupling process.

In accordance with another aspect of the invention, the energy storing means comprises a spring accumulator which is coupled to means displaceable during the coupling process and thereupon is energized. An unlocking device is employed in the decoupling process and releases the spring accumulator which provides the bulk of the energy in the decoupling process.

In a preferred embodiment, the vehicle is provided with similar coupling heads at opposite ends, each coupling head comprising both a tension bolt and a bolt receptacle, so that either vehicle end can be coupled to any other similar coupling head on another vehicle.

Other aspects and advantages of the invention are described below in connection with an examplary embodiment, which is not intended to be limiting, and will also be found in the appended claims.

SUMMARY OF DRAWINGS

An exemplary embodiment of the invention, by way of example, will now be described, reference being had to the accompanying drawings, wherein.

DETAILED DESCRIPTION OF PREFERRED EMBODIMENT

Figure 1:
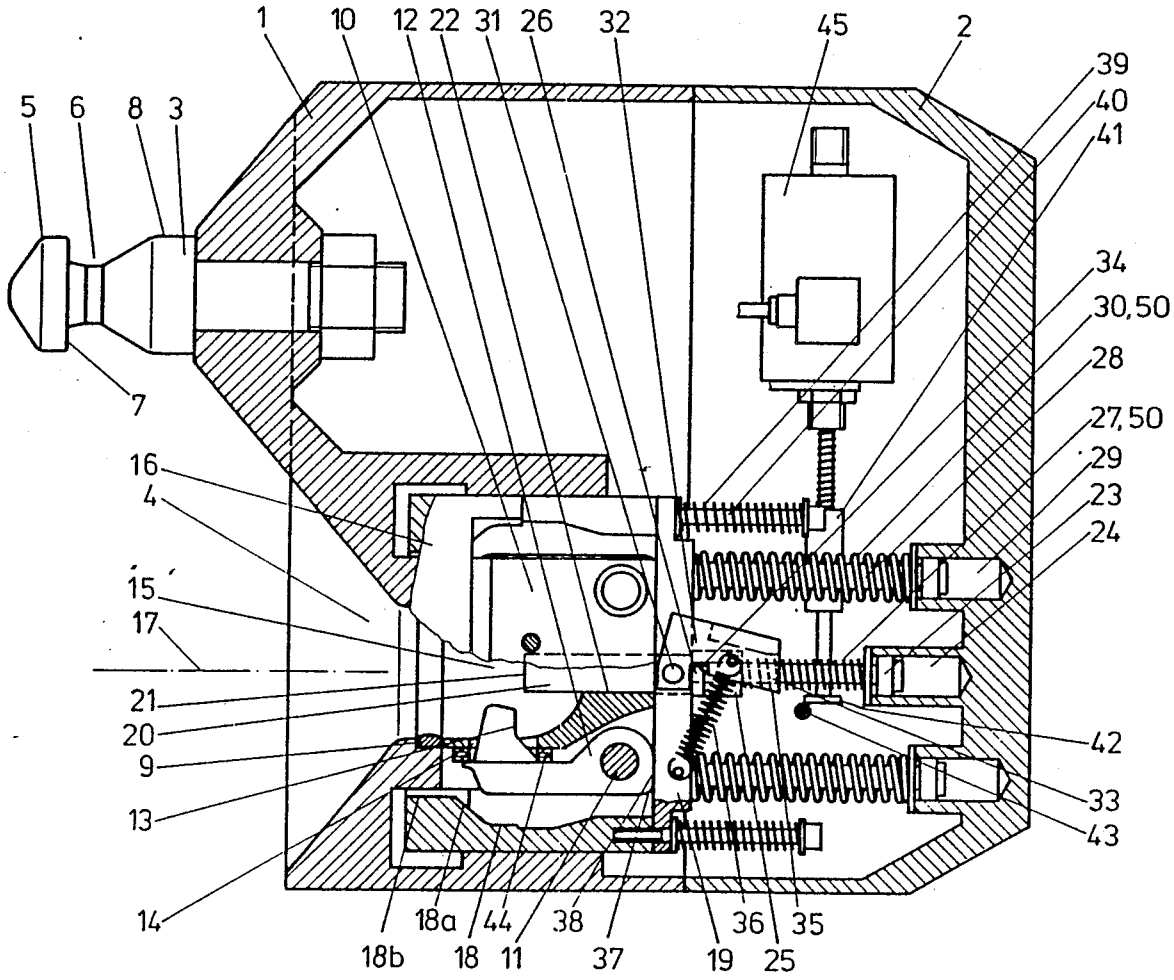
FIG. 1 is a section through a coupling half in readiness for the coupling process.

FIG. 1 shows in cross-section one of two similar coupling heads typically at each vehicle end. A projecting tension bolt or tie bolt 3 and a tension bolt receptacle 4 are arranged at a head piece 1. The tension bolt 3 has a conical bolt head 5, a turned-down portion 6 with a frontal clamping face 7 and a cylindrical centering portion 8. The tension bolt receptacle 4 comprises a wear-resistant centering ring 9 arranged in the head piece 1 and a receptacle 10 fixedly connected with this centering ring in the head piece 1. Two catch or engagement levers 12, the second (not shown) above, are pivotably supported on two bolts 11 in the receiving part 10. The nose-shaped engagement portions 13 of each lever 12 can be pivoted through apertures 14 in the receiving part 10 into the inner face 15 of said receiving part. Each engagement lever 12 comprises a pressure cam 37 with a contact surface 38 in the region of the support at the bolt 11. The apertures 14 are sealed by contact of the engagement lever 12 at the seals 44 in its pivoted inward state as shown in FIG. 1, so that no dirt or impurities can penetrate from the tension bolt receptacle 4 into the space inside the head piece 1.

A frame member 16 of the coupling head is supported displaceably in the direction of the longitudinal axis 17 of the tension bolt receptacle 4, parallel to that of the tension bolt 3 in the head piece 1, and the frame embraces the receiving portion 10 with the engagement levers 12.

The frame 16 comprises, respectively, a contact contour 18 which cooperates with the engagement levers 12. Two guide bolts 40 are fastened at the frame 16, on which bolts 40 a crosshead member 19 is supported so as to be displaceable relative to the frame 16 against the pressure of compression springs 39.

A pressure bar 20 is slidably mounted through a bore in the crosshead 19 and is also arranged coaxially with the longitudinal axis 17; one end 21 of the pressure bar 20 is located in a bore 22 of the receiving part 10 and extends into the space 15 inside the receiving part 10, whereas the other end 23 of bar 20 is guided in a blind hole 24 in the rear part 2 of the housing. A follower member 25, having lugs 26, is arranged on the pressure bar 20 resting at an offset face or surface. The follower 25 has two lugs or head pieces 26 located radially opposite each other. Between the follower 25 and the rear part 2 there is also arranged a compression spring 27, which presses the follower 25 against the offset face of the pressure bar 20.

Guide bars 28, located on both sides of the pressure bar 20, are fastened to the crosshead 19, and the guide bar free ends are guided in the blind holes 29 of the rear part 2 and on which compression springs 30 abutting at the rear part 2 and at the crosshead 19 are arranged.

A latch 32 is mounted at the crosshead 19 to be pivotable around a bolt 31, which latch comprises, extending above and below the connection of the crosshead 19 to the pressure bar 20, one each lever arm 33 with, respectively, one recess 34 and one stop face 35. Between the crosshead 19 and the latch 32 tension springs 36 are arranged at the top and at the bottom, which pull the latch 32 against the follower 25, so that the follower lugs 26 are held in the latch recesses 34.

A lifting magnet or solenoid 45 is mounted in the rear housing part 2. The solenoid shaft comprises an unlocking bar 41 to which a collar 42 forming a stop face is fastened, whose direction of motion preferably extends transversely to the longitudinal axis 17. Instead of the solenoid 45, it is also possible to utilize a compressed air cylinder controllable, for instance, by magnetic valves, or an electric motor with stepdown gear box.

An active part 43 is arranged in the rear part 2 on the side of the pressure bar 20. The part 43 is actuated by a linkage which is not depicted here and is not critical to the invention. The pivoting motion of the active part 43 occurs preferably transversely to the longitudinal axis 17.

The lever ratio at the latch 32, as far as the point of application of the unlocking bar 41 and the active part 43 for contact of the head pieces 26 in the recess 34 is concerned, is preferably L:1=5:1.

FIG. 1 shows the coupling head in the state ready for coupling, wherein the crosshead 19 is pressed by the compression of the spring 30 against the pressure cams 37 of the engagement levers 12, so that these lie in a sealing manner at the receiving part 10 in their pivoted inward position. The frame 16 and the pressure bar 20 are in one end position (left side in FIG. 1) in the direction of the tension bolt receptacle, which is also caused by the compression springs 30 or the compression spring 27.

Figure 2:
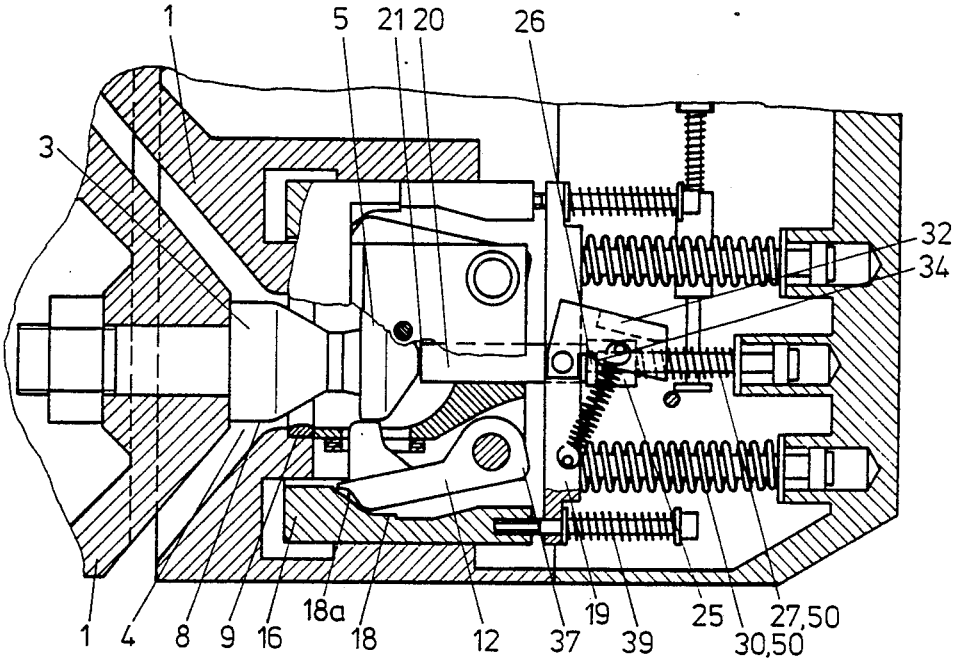
FIG. 2 is a partial section of FIG. 1 in an intermediate position during the coupling of two coupling heads.

When two coupling heads are brought together (sequence of motion between FIGS. 1 and 2), the two coupling heads are automatically aligned at the tension bolt receptacle 4 because of the head shape of the tension bolt 3 and the conical design of the head piece 1, so that the tension bolt 3 of one coupling head can move into the tension bolt receptacle 4 of the other coupling head. In the course of further interpenetration of the couplings, the engagement or locking levers 12 are pivoted outwardly because of the cone shape of the bolt head 5, until they rest at the cylindrical part of the bolt head 5. Simultaneously the crosshead 19 is shifted backwards by a small amount (approximately 2 mm) by the pressure cams 37 of the locking levers 12, the pressure springs 27 and 30 being pressed together by the same amount, which pulls along the frame 16 causing a prestressing force of the pressure springs 39.

In the course of continued interpenetration, the bolt head 5 comes to rest at the left end face 21 of the pressure bar 20 and presses it backwards, whereupon the crosshead 19 is also displaced by the head pieces or lugs 26 of the follower 25 and the latch 32 arranged at the crosspiece 19, whereby the spring accumulator 50 formed by the compression springs 27 and 30 is further energized. The crosshead 19 pulls the frame 16 with it because of the springs 39, until said frame is held by the engagement lever 12 with its inclined portion 18*a* at the contact contours 18.

In the course of further interpenetration (FIG. 2), the crosshead 19 is pushed backwards by the tension bolt 3, the pressure bar 20, the head pieces 26 of the follower 25 and the recesses 34 of the latch 32, whereby the spring accumulator 50 formed by the springs 27 and 30 is further energized. Simultaneously, the compression springs 39 are tensioned by the head piece 19 being pushed back and by the frame 16 blocked by the engagement lever 12. In the course of still further interpenetration of the couplings the spring accumulator 50 formed by the compression springs 27 and 30 and the pressure springs 39 is tensioned further, thereby storing more energy, until the abutting faces of the head parts 1 touch each other.

Several millimeters before the abutting faces of the head pieces 1 come together, the couplings are accurately aligned or centered by the centering portion 8 of the tension bolt 3 and the centering ring 9.

Figure 3:
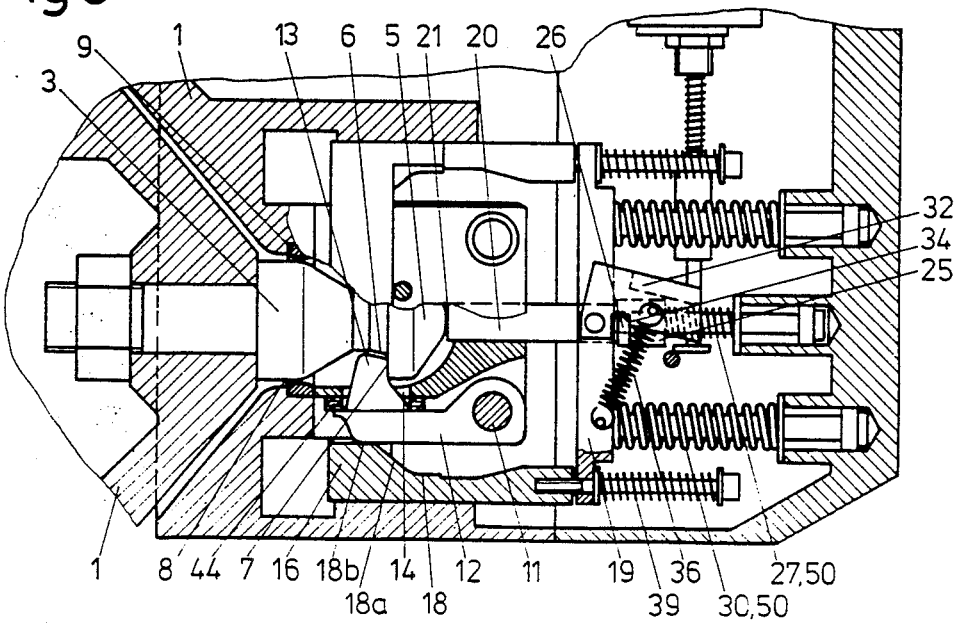
FIG. 3 is a partial section of FIG. 1, wherein both coupling halves are coupled and locked.

Upon impacting of the two abutting faces of the head part 1, further penetration of the tension bolt 3 is stopped (FIG. 3). The tension bolt 3 has pushed the crosshead 19 into its rearmost position through the pressure bar 20, the follower 25 and the latch 32, so that the spring accumulator 50 formed by the compression springs 27 and 30 is entirely energized. Because of the release of the displaced bolt head 5 of the tension bolt 3, the engaging portions 13 of the engaging levers 12 were pivoted by the frame 16 into the turned-down portion 6 of the tension bolt 3. The inward pivoting of lever 12 occurs through displacement of the frame 16 to the right by the force of the energized springs 39, wherein the inclined portion 18*a* of the contact contour 18 presses the engagement levers 12 inward. The couplings are now locked because of the fixed contact of the engagement levers 12 via the engagement portion 13 at the frontal face 7 of the tension bolt 3, and the engagement levers are blocked from outward movement through contact at the straight contour 18*b* of the frame 16 (see FIG. 3). The lever ratio at the engagement lever 12 is H:h, preferably 3:1.

Figure 4:
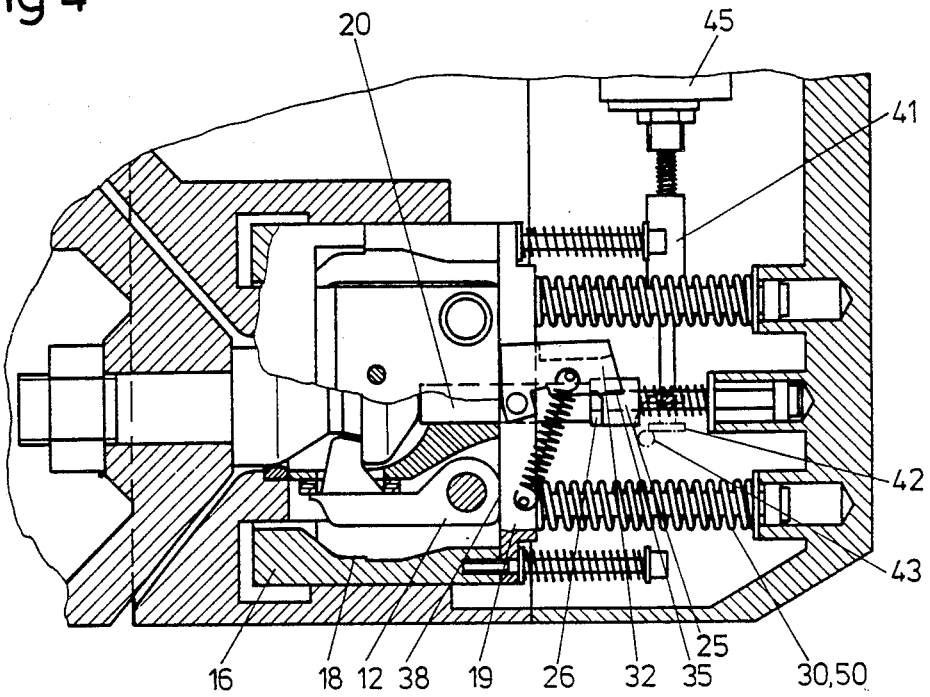
FIG. 4 is a partial section of FIG. 1 in the unlocked position and ready for decoupling, but the couplings have not yet been pulled apart.

FIG. 4 shows the couplings in an unlocked, ready to be decoupled position, but the couplings have not yet been pulled apart. For the decoupling operation, the unlocking occurs either from the operator's cab of the train through remote control or switching on of the lifting magnet 45 or of an air cylinder or a geared motor, or by manual operation of the active part 43. In the one case, the collar 42 of the unlocking bar 41 and, in the other case, the active part 43 during the manual operation is pressed against the stop face 35 of the latch 32, whereby the latch 32 is pivoted outwards and snaps out of the head pieces or lugs 26 of the follower 25. This releases the connection between the crosshead 19 and the pressure bar 20, whereupon the crosshead 19 is pushed forward (to the left) together with the frame 16 by the energy stored in the compression springs 30, until the crosshead 19 abuts at the stop faces 38 of the engaging levers 12. The engagement levers 12 are now unlocked, as is discernible from FIG. 4, since these can now pivot out into the contour 18 by the release.

Figure 5:
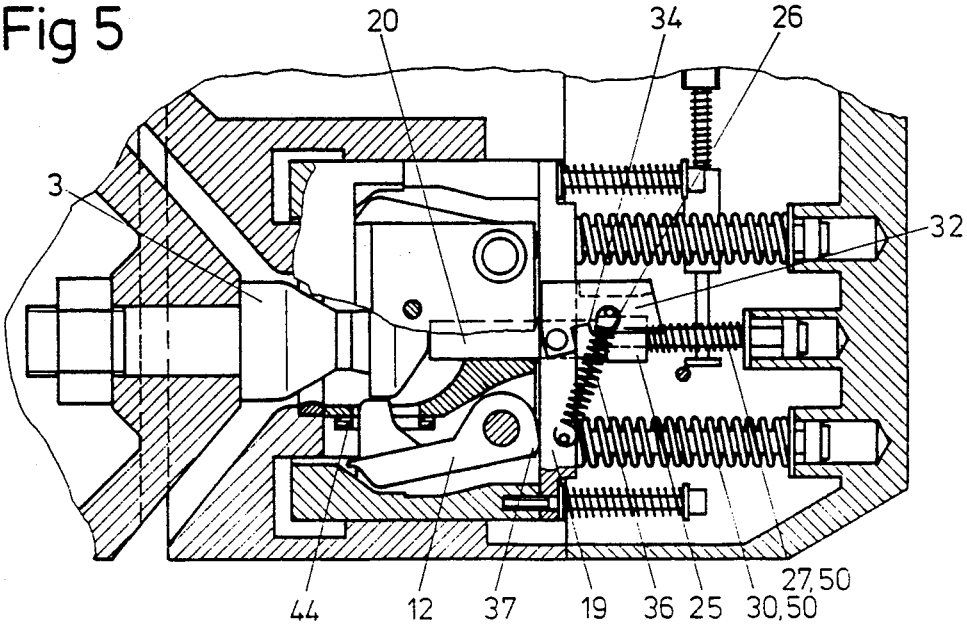
FIG. 5 is a partial section of FIG. 1 in the unlocked and decoupled position, wherein the coupling heads ar partially pulled apart.

When pulling the coupling heads further apart (see FIG. 5) the engagement levers 12 are now pivoted outwards, and their pressure cams 37 shift the crosshead 19 somewhat backwards against the pressure of the springs 30. If the tension bolt 3 is located outside of the region of the engagement levers 12, the engagement levers are pressed again against the seals 44 (see FIG. 1) because of the pressure of the springs 30 through the crosshead 19 upon the pressure cams 37. When the tension bolt 3 is finally pulled out, the pressure bar 20 is shifted forwards by the force of the pressure spring 27 and the follower 25 up to the stop of the follower 25 at the crosshead 19. Through the effect of the tension spring 36, the latch 32 snaps with its recess 34 over the head pieces 26 of the follower 25, whereupon the entire mechanism has again been brought automatically into the "ready for coupling" position as shown in FIG. 1.

The described arrangement and functional mode of the locking mechanism enables decoupling with a small applied force even when a large tractive force is acting, which is possible with an appropriately small and inexpensive lifting magnet. If one has, for instance, to decouple the coupling with a tractive force $P_z$ applied, then a force $Z = P_z/2$ acts upon the locking mechanism. This force Z is reduced by the lever ratio of the engagement lever 12 of H:h =3:1, so that P =z/3. This generates a required advance force V at the frame 16 with a coefficient of friction $\mu_1$ between the engagement lever at the frame with the advance force being $V = \mu_1 \cdot P$. The force R at the unlocking point is reduced by the coefficient of friction $\mu_2$ between the latch 32 and the head piece 26 to $R = \mu_2 \cdot V$. Because of the lever ratio at the latch 32 of L:l =5:1, the force M required at the unlocking bar 41 is reduced to M - R/5, which is increased by the acting spring force. The force required for unlocking at the unlocking part is therefore considerably reduced compared to the tractive force acting upon the tension bolt.

The arrangement of a spring accumulator in the invention makes it possible that same is energized during the coupling process and yields its energy during the uncoupling process, in order to return the locking mechanism again into the "ready for coupling" position. Yet, in the coupled state a secure locking of the engagement levers 12 is assured by the frame 16. The mechanism of the invention thus takes advantage of the energy provided by the moving coupling vehicles to provide a means for unlocking the coupling with relatively small externally provided energy.

The above-described embodiment being exemplary only, it will be understood that various modifications thereof, as will be evident to those skilled in this art, are within the purview of the invention.

We claim:

1. Automatic coupling for a rail vehicle having two similar coupling heads, each said coupling head comprising:

(a) a tension bolt;
(b) a tension bolt receptacle;
(c) a locking mechanism in the receptacle;
(d) a unlocking device connected to the locking mechanism;
(e) means connected to the locking mechanism and operable during the coupling process for storing energy;
(f) means operable upon actuation of said unlocking device to release the energy stored in said energy storing means for actuating said locking mechanism so that it will allow decoupling.

2. The apparatus of claim 1, wherein the energy storing means comprises springs, the locking mechanism comprises a displaceable frame and a lever having locked and unlocked positions and actuable by the frame, said springs maintaining the frame before coupling in a position such that the lever is free to move, said frame being displaceable during the coupling process to a position which compresses the springs and locks the lever.

3. Automatic coupling for a rail borne vehicle having two similar coupling heads with each coupling head comprising both a tension bolt and a tension bolt receptacle provided with a locking mechanism connected with an unlocking device, characterized in that the coupling head comprises a spring accumulator operable during the coupling process for storing energy, and means operable during the decoupling process by the energy stored in the spring accumulator for bringing the locking mechanism into a position whereby a head can be decoupled and is made ready for the next coupling.

4. Coupling according to claim 3, characterized in that the locking mechanism comprises a pivotable engagement lever engageable with a tension bolt, and a displaceable frame having a contact contour configured to block movement of the lever.

5. Coupling according to claim 4, characterized in that the spring accumulator comprises compression springs mounted to be energized, and the head comprises a pressure bar and a displaceable cross-head connected with said pressure bar for energizing the springs.

6. Coupling according to claim 5, characterized in that the frame is connected to the displaceable crosshead by means of a frictionally locked connection, said frame and crosshead being displaceable relatively to each other in the direction of pull against the force of pressure springs.

7. Coupling according to claim 5, characterized in that a pivotable latch is connected to the crosshead, said latch being connected via a follower to the pressure bar.

8. Coupling according to claim 7, characterized in that head pieces are provided at the follower, said head pieces interactively connecting with recesses of the latch by the tractive force of at least one spring.

9. Coupling according to claim 7, characterized in that the unlocking device comprises an active part actuatable manually.

10. Coupling according to claim 7, characterized in that the unlocking device comprises a remotely controllable unlocking bar and a pneumatically or electrically operating device for actuating the bar.

11. Coupling according to claim 9, characterized in that the active part presses upon an upper stop face of the latch during its radius of motion.

12. Coupling according to claim 10, characterized in that the unlocking bar comprises a collar coacting with a lower stop face of the latch.

13. Coupling according to claim 7, characterized in that at least two pressure springs are arranged between the crosshead and a contact face of a rear part of the coupling head, and a further pressure spring is arranged so as to be guided upon the pressure bar between the follower and the contact face of the rear part.

14. Coupling according to claim 5, characterized in that the engagement lever comprises a pressure cam actuable by the crosshead for moving the engagement lever and the crosshead.

15. Coupling according to 14, characterized in that the engagement lever has a lever ratio of approximately h:H =1:3 between the line of action of the tractive force at the contact face at the clamping surface of the tension bolt and the contact face in blocking position at the contact contour of the frame.

16. Coupling according to claim 8 or 14, characterized in that the latch has a lever ratio of approximately 1:L =1:5 between the contact of the head piece of the follower at the recesses and a line of action of the locking force applied by the unlocking bar at the latch.

* * * * *